US006845828B2

(12) United States Patent
Boyce

(10) Patent No.: US 6,845,828 B2
(45) Date of Patent: Jan. 25, 2005

(54) SHAPED CUTTING-GRADE INSERTS WITH TRANSITIONLESS DIAMOND-ENHANCED SURFACE LAYER

(75) Inventor: James E. Boyce, Cedar Hill, TX (US)

(73) Assignee: Halliburton Energy Svcs Inc., Houston, TX (US)

( * ) Notice: Subject to any disclaimer, the term of this patent is extended or adjusted under 35 U.S.C. 154(b) by 83 days.

(21) Appl. No.: 09/923,249

(22) Filed: Aug. 3, 2001

(65) Prior Publication Data

US 2002/0037200 A1 Mar. 28, 2002

Related U.S. Application Data

(60) Provisional application No. 60/223,536, filed on Aug. 4, 2000.

(51) Int. Cl.[7] ..... E21B 10/36
(52) U.S. Cl. ..... 175/420.2; 175/426
(58) Field of Search ..... 175/420.1, 420.2, 175/426, 434

(56) References Cited

U.S. PATENT DOCUMENTS

| | | | | |
|---|---|---|---|---|
| 5,335,738 A | * | 8/1994 | Waldenstrom et al. | 175/420.2 |
| 5,594,931 A | * | 1/1997 | Krall et al. | 419/5 |
| 5,871,060 A | | 2/1999 | Jensen et al. | |
| 5,944,129 A | | 8/1999 | Jensen | |

FOREIGN PATENT DOCUMENTS

| | | |
|---|---|---|
| EP | 0 399 679 | 11/1990 |
| GB | 2 307 933 | 6/1997 |

* cited by examiner

*Primary Examiner*—William Neuder
(74) *Attorney, Agent, or Firm*—Groover & Holmes

(57) ABSTRACT

A thin layer of carbide containing an ultra-hard component, such as diamond, is applied to a formed compact for a drilling tool. The compact is then subjected to a high-temperature, high-pressure process to bond it to the added layer. This process allows the use of an underlying substrate which has a lower binder content than previously possible. The compact provides superior cutting ability, as even if the diamond-enhanced layer wears through, the carbide can provide enhanced hardness.

7 Claims, 9 Drawing Sheets

| Grade | Composition |
|---|---|
| 11493 ( composite ) | 60% N410, 40% NP32 |
| N410 | 10% cobalt, balance 4 micron WC |
| NP32 | 6% cobalt, balance submicron WC |

*FIG. 14*

| Grade | Density | Hardness | TRS* | HC* | Porosity |
|---|---|---|---|---|---|
| N410 | 14.55 | 88.5 | 400,000 | 95 | A02 |
| NP32 | 14.95 | 92.7 | 380,000 | 280 | A02 |
| 11493 | 14.70 | 90.2 | 400,000 | 160 | A02 |

*FIG. 15*

SHAPED CUTTING-GRADE INSERTS WITH TRANSITIONLESS DIAMOND-ENHANCED SURFACE LAYER

CROSS-REFERENCE TO OTHER APPLICATION

This application claims priority from 60/223,536 filed Aug. 04, 2000, which is hereby incorporated by reference.

BACKGROUND AND SUMMARY OF THE INVENTION

The present invention relates to inserts used in rotary cone drill bits and related drilling tools.

Background: Rotary Drilling

Oil wells and gas wells are drilled by a process of rotary drilling. In a conventional drill rig, as seen in FIG. 12 a drill bit 130 is mounted on the end of a drill string 132, made of many sections of drill pipe, which may be several miles long. At the surface a rotary drive turns the string, including the bit 136 at the bottom of the hole, while drilling fluid (or "mud") is pumped through the string by very powerful pumps 134. The bit 136 is generally one of two types: either a rotary cone drill bit, such as the one seen in FIG. 10, or a fixed head bit, such as is seen in FIG. 11. These bits, which are generally formed of steel, will have structures for cutting or grinding the formation being drilled. One type of cutting or shearing structure is teeth, which are cut out of the steel of the bit body and generally coated with a hardfacing for wear resistance. For cutting or grinding, inserts formed of a harder material such as tungsten carbide are fastened into sockets specially formed within the bit to hold them.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours and is a significant expense in the drilling budget. To resume drilling the entire process must be reversed. Thus the bit's durability is very important, to minimize round trips for bit replacement during drilling.

Background: Diamonds in Inserts

Diamonds have been used to enhance the hardness of inserts for a number of years. In one process, tiny polycrystalline diamonds (about 0.001 mm) are mixed with a metal and formed into a cylindrical buttons or compacts, which are used alone or bonded to a tungsten carbide post to form the insert.

In several patents, a flat layer of polycrystalline diamond material is bonded to a backing layer of a less hard material, such as tungsten carbide. Various embodiments of this are shown in Barr et al. (U.S. Pat. No. 5,025,874), Griffin (U.S. Pat. No. 5,111,895), Smith (U.S. Pat. No. 5,351,772)

Some processes enclose a core of ultra-hard material in a jacket of, for example, tungsten carbide (see Scott et al. (U.S. Pat. No. 5,348,108 and U.S. Pat. No. 5,248,006), Grimes et al. (U.S. Pat. No. 5,287,936), and Jurewicz, U.S. Pat. No. 5,273,125)). Other processes place the ultra-hard material as the outer layer, totally or partially covering a core of tungsten carbide, e.g. Waldenström et al. (U.S. Pat. No. 5,335,738 and U.S. Pat. No. 5,154,245), Tibbitts (U.S. Pat. No. 5,337,844), Tibbitts et al. (U.S. Pat. No. 5,279,375), and Keshavan et al.

Background: Tungsten Carbide

Tungsten carbide is produced in a number of different grades, with different sizes of tungsten particles, different binders, and different percentages of binder present. Generally, the formulations containing a larger percentage of binder are considered tougher (more fracture resistant) and easier to bond to, while a lower percentage of binder gives a harder and more wear resistant insert. Historically, when an overlying layer was to be added, the substrate would have a binder content of at least 13% to provide a good bond to the added layer.

Background: Inserts of Two Carbide Formulations Dispersed in each other

U.S. Pat. No. 4,956,012, which is owned by Newcomer Products, Inc., (one of the joint assignees) discloses a method of making drilling inserts by mixing nodules of pre-blended, un-sintered metal carbide/binder composites having certain desirable characteristics such as a very high hardness, oxidation resistance or gall resistance, and dispersing these nodules into other pre-blended, un-sintered and pelletized metal carbide/binder compositions having other desirable characteristics such as high toughness, corrosion resistance, or other property. The dispersion of the first composite into the second composite occurs prior to pressing and sintering of the mixture. In this manner, the integrity of the separate grades is maintained, while the properties of the new composite are enhanced.

Background: Layered Insert without Adhesive

U.S. Pat. No. 5,594,931, which is owned by Newcomer Products, Inc. (NPI), discloses an insert having a core made of a first grade of cobalt- or nickel-bonded tungsten carbide (typically a relatively tough composition) with a surface layer of a second grade of distinctively different cobalt- or nickel-bonded tungsten carbide (typically a hard, wear-resistant formulation). The bond between these layers is excellent without the need for an adhesive or transition layer.

Harder Inserts Having Seamless Diamond-Enhanced Surface

The present application discloses a shaped insert for a drilling tool, such as a drill bit, the insert having a diamond-enhanced layer which is seamlessly bonded over the working surface. Because of the technique used, the diamond-enhanced layer can be bonded to a substrate which contains less than the traditional 13% binder. This means that it is possible to have a harder insert initially and still be able to bond to it a layer which is enhanced with diamonds or other ultra-hard materials. In one embodiment, the substrate is composed of nodules of a harder grade of carbide dispersed within a less hard, more durable matrix of tungsten carbide, over which the layer having a superhard coating is applied. The coating, one embodiment of which contains bare diamonds and carbide, is coated onto a sintered or pre-sintered insert, which is then treated with a high temperature, high pressure process. No transition layer or adherent material is necessary to bond the ultra-hard layer onto the insert.

The disclosed innovations, in various embodiments, provide one or more of at least the following advantages:

- the process is simple;
- the bond is strong;
- the performance is increased;
- diamond-enhanced layer gives increased lifetime;
- increased flexibility of deciding toughness/hardness of substrate.

BRIEF DESCRIPTION OF THE DRAWING

The disclosed inventions will be described with reference to the accompanying drawings, which show important sample embodiments of the invention and which are incorporated in the specification hereof by reference, wherein:

FIG. 14 is a table showing the composition of the tungsten carbide grades used in the presently preferred embodiment.

FIG. 15 is a table of the relative physical properties of the grades of tungsten carbide used in the body of the disclosed insert.

DETAILED DESCRIPTION OF THE PREFERRED EMBODIMENTS

The numerous innovative teachings of the present application will be described with particular reference to the presently preferred embodiment (by way of example, and not of limitation).

Presently Preferred Embodiment

Figure 7:
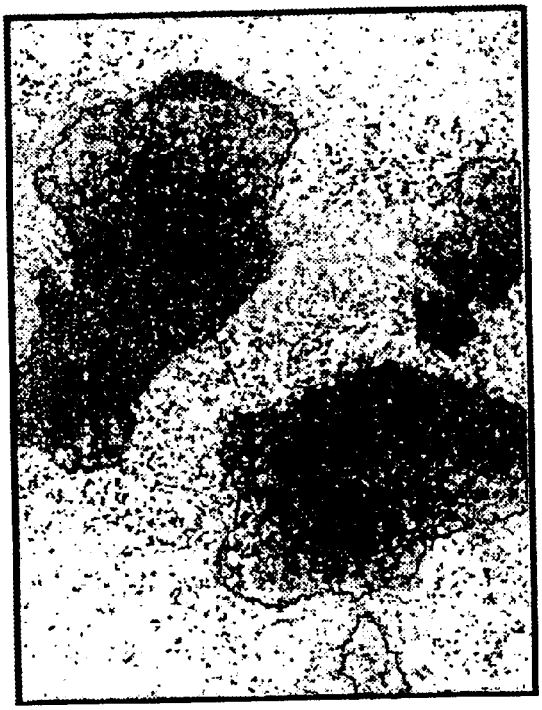
FIG. 7 is an SEM photo of an exemplary composite of the two grades shown in FIGS. 5 and 6.
Figure 8:
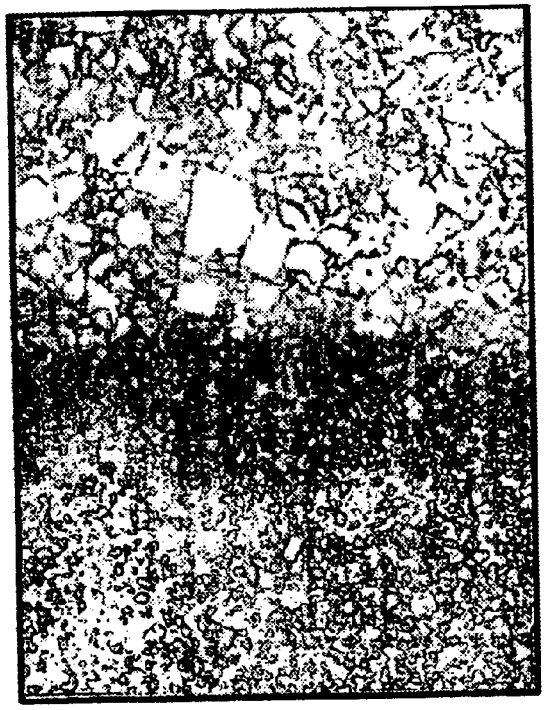
FIG. 8 is an SEM photo of the interface between the two carbides in the composite of FIG. 7.
Figure 13:
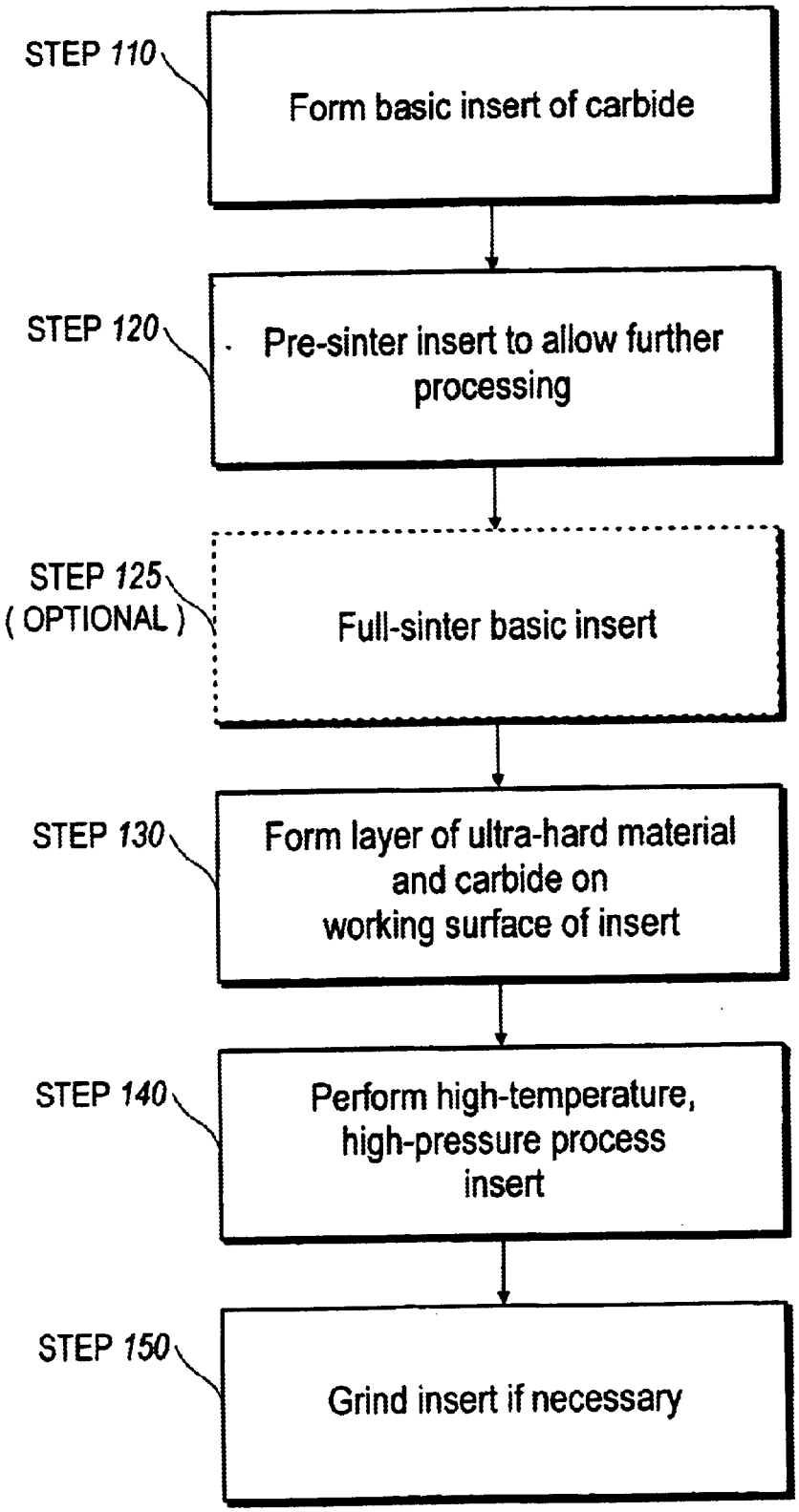
FIG. 13 is a flowchart of the process of manufacturing the disclosed insert.

Formation of the disclosed insert will now be discussed with reference to FIG. 13, which is a flowchart of the process, and to FIGS. 2–8, which exemplify various aspects of the insert. In step 1410, the basic insert is formed. This is preferably done using the process which was disclosed in U.S. Pat. No. 4,956,012, which is hereby incorporated by reference. In this process, pellets of tungsten carbide are formed from two different grades of tungsten carbide, one to provide the desired hardness, the other to provide the toughness. In the presently preferred embodiment, the grades are grades NP32 and N410 of Newcomers Products, Inc.'s (NPI), the composition of which is shown in FIG. 14. Grade NP32 (for hardness) consists of submicron size tungsten carbide particles with 6% cobalt (seen in an scanning electron microscope (SEM) photo in FIG. 5), while grade N410 (for toughness) consists of 4 micron particles of tungsten carbide with 10% cobalt (seen in FIG. 6). These pellets are formed by any pelletizing process, such as vibratory pelletizing, wet pelletizing, spray drying, etc. The pellets are gently dry-mixed, using 60% by weight of N410 pellets and 40% of NP32 to form new composite grade 11493. Relative physical properties of these grades are shown in FIG. 15. The mixed pellets are pressed and pre-sintered at a low temperature which is sufficient to permit handling of the green insert for further processing (step 1420) of FIG. 13. Optionally, a full sinter to densify the insert can be performed at this point (step 1425). FIG. 7 is an SEM photo of an exemplary composite of the two grades after densification, while FIG. 8 is an SEM photo of the interface between the two carbides.

Next, a layer of diamonds mixed with tungsten carbide is coated onto the cutting surface of the insert, using a process similar to that disclosed in U.S. Pat. No. 5,594,931 to NPI, which is hereby incorporated by reference. In the presently preferred embodiment, a mixture of 2 micron and 20 micron particles of bare diamond are added to the base powder mix for a 313 carbide cermet formulation. This mixture is then mixed with a liquid vehicle as described in the referenced patent, and an even coating of the mixture is applied to the cutting surface of the prepared insert (step 1430).

Figure 1:
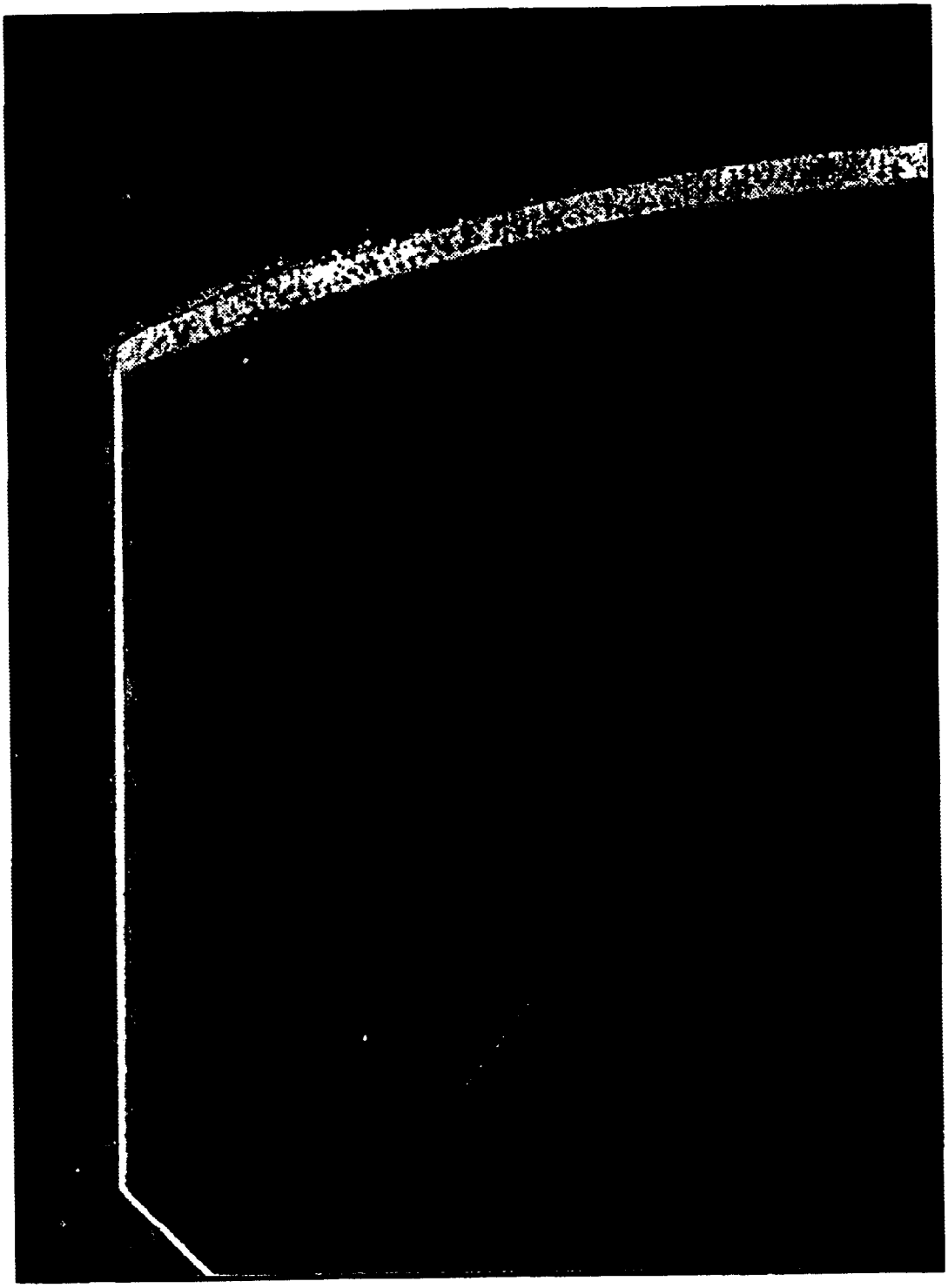
FIG. 1 is a photomacrograph of a cross section of a PDC dome insert according to one embodiment of the invention.
Figure 2:
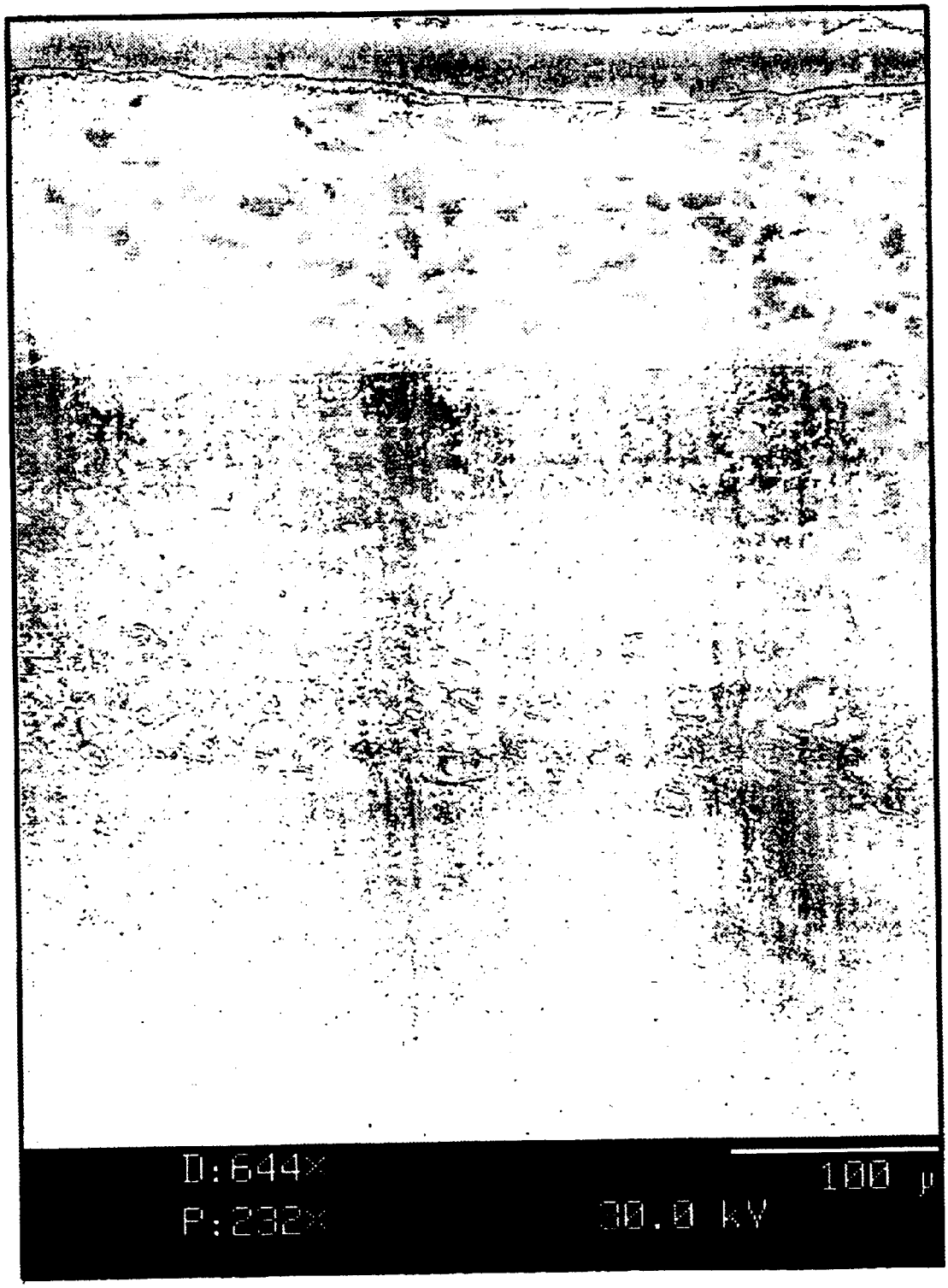
FIG. 2 is a scanning electron microscope (SEM) photo of the insert of FIG. 1 and shows the distribution of the diamonds throughout the coating.
Figure 3:
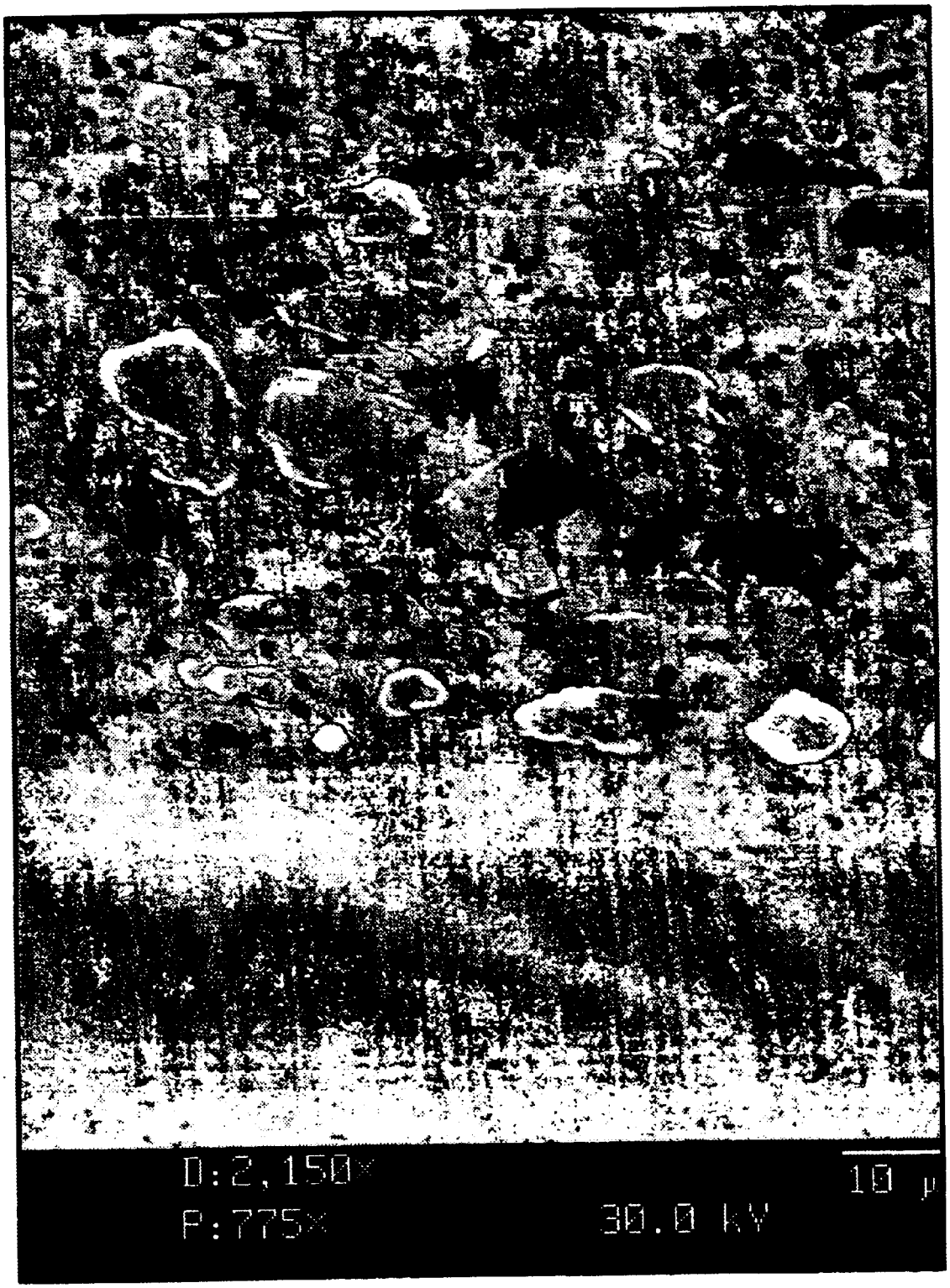
FIG. 3 is a further SEM photo of the insert of FIG. 1, showing the metallurgical bond at the interface of the coating and carbide substrate.
Figure 4:
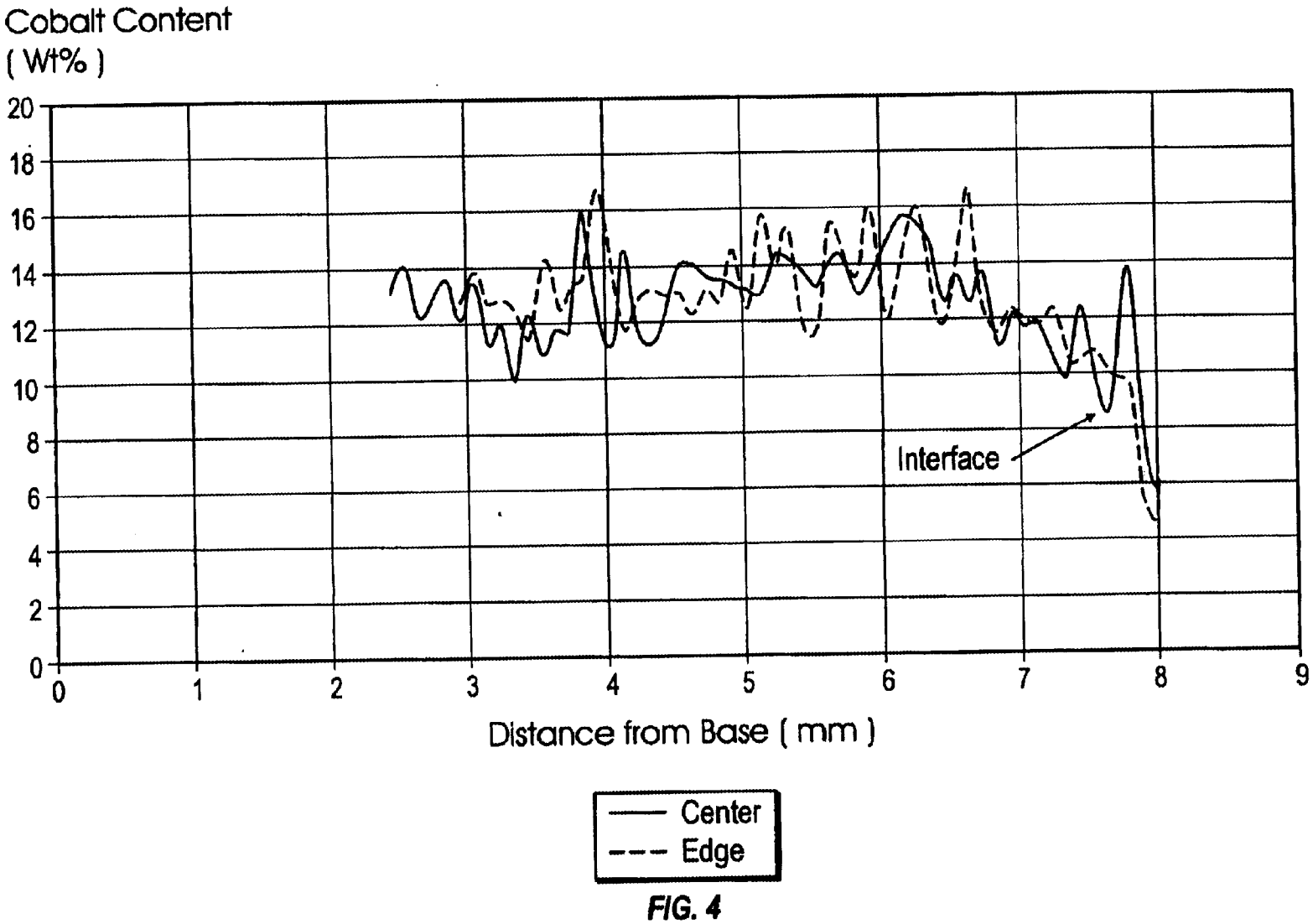
FIG. 4 is a graph of the cobalt profile in one embodiment of the innovative insert.
Figure 5:
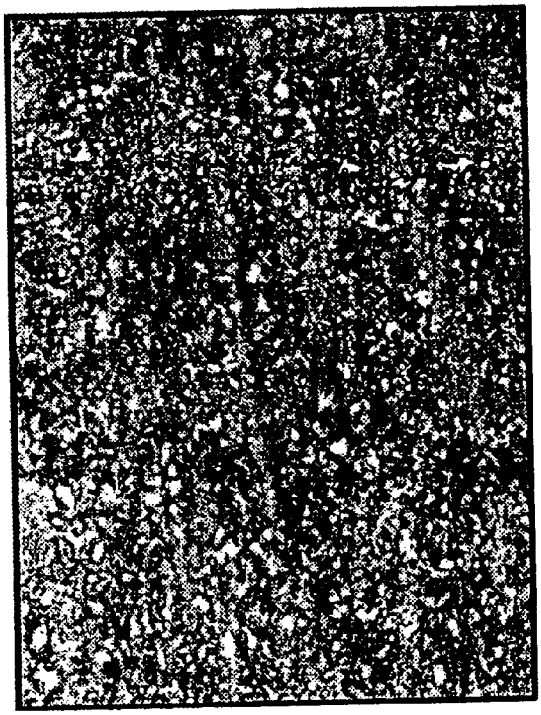
FIG. 5 is an SEM photo of a grade NP32 carbide formulation.
Figure 6:
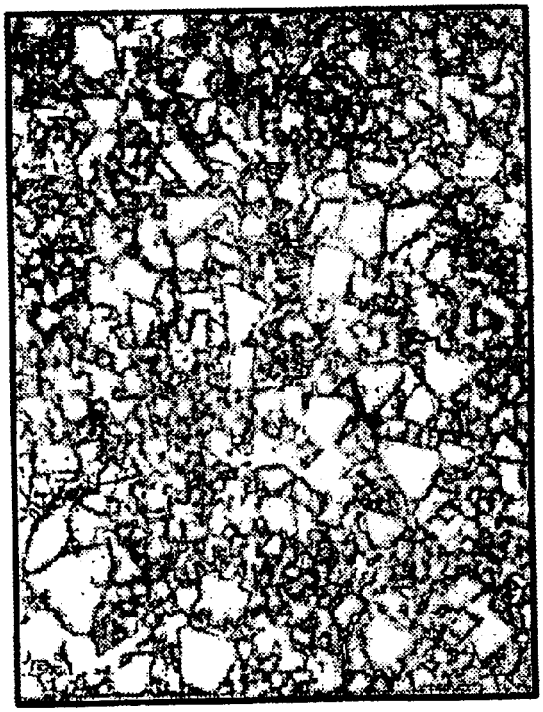
FIG. 6 is an SEM photo of a grade N410 carbide formulation.

Finally, the insert is subjected to a high-temperature, high-pressure anneal to produce a fully densified insert having a well-bonded diamond-containing surface layer (step 1440). FIG. 1 is a photomacrograph of a cross section of a PDC dome insert having this diamond layer, but without the underlying mix of composite grades. The coating layer is approximately 0.010 inches thick. FIG. 2 is an SEM photo of the insert of FIG. 1 and shows the distribution of the diamonds throughout the coating, while FIG. 3 is a further photo, showing the metallurgical bond at the interface of the coating and carbide substrate.

If necessary, the insert can be ground (step 1450), either to improve its fit into the receiving socket, or after fitting in the bit, e.g., to fine-tune the gage of the bit. However, it should be noted that because of the very thin layer diamond-enhanced layer, it is preferable that as little grinding as possible is done to this layer.

Sample and Testing of Diamond-Enhanced Layer

Figure 9:
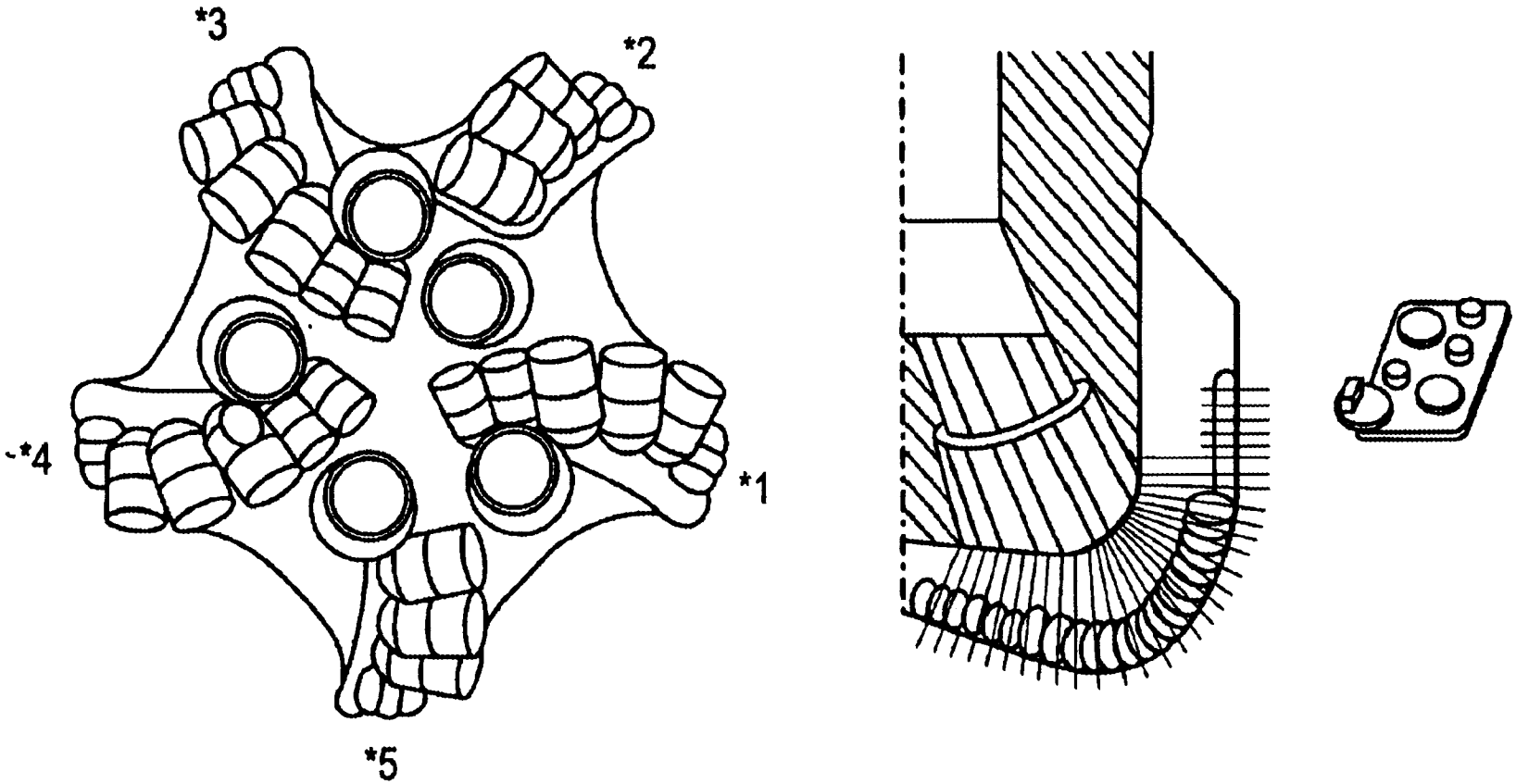
FIG. 9 is a layout of one of the test bits, showing the dome insert locations on the bit pads.
Figure 10:
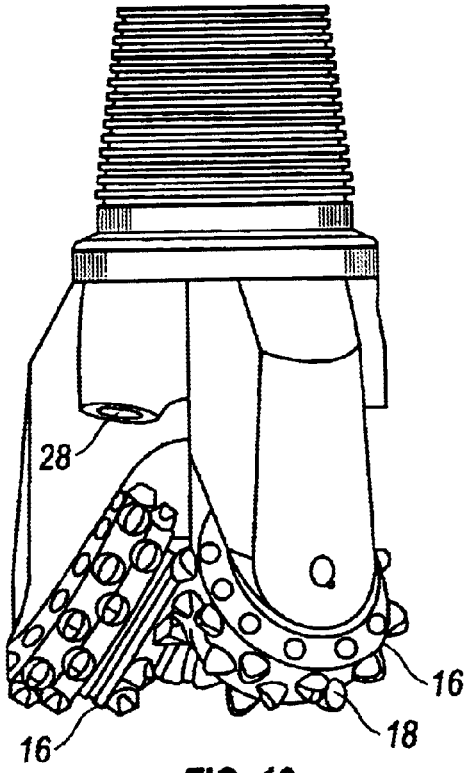
FIG. 10 shows a rotary cone drill bit which can use the innovative inserts.
Figure 11:
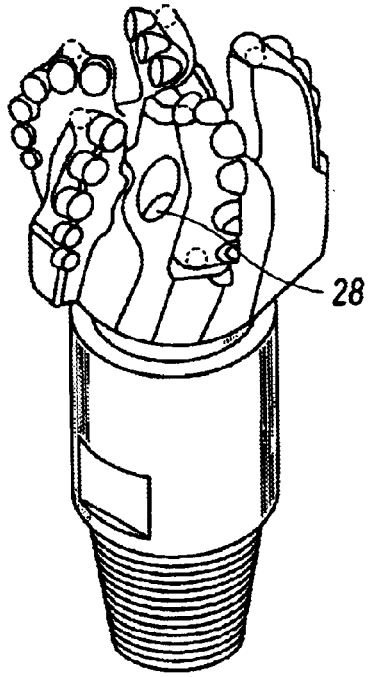
FIG. 11 shows a fixed head drill bit which can use the innovative inserts.
Figure 12:
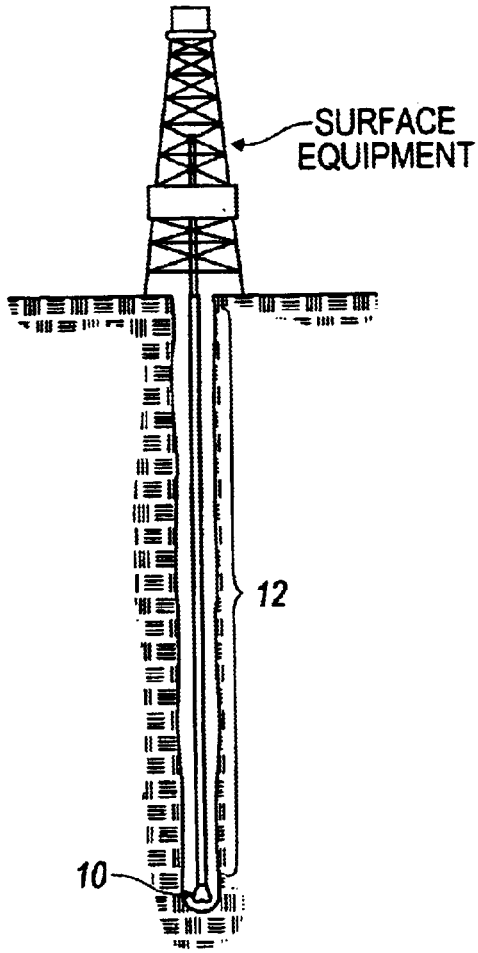
FIG. 12 shows a drill rig which can use the disclosed insert in a bit.

In initial testing of the diamond-enhanced layer, a number of semi-dome inserts were coated and treated. The diamond thickness was around 0.010 inches and the inserts were brazed into three of the five gage pads of a fixed-head bit (above the cutters marked 2, 3, and 5), as seen in FIG. 9. The bit was run in a well in Tyler, Tex. After the run, the cutters were debrazed and checked. Wear was evident in the center of the cutter, which may have been done during the over-dimension grind process that was performed, prior to the test. The cutters appeared to have passed the initial tests; other than the wear, the cutters remained intact.

A microcrack was found in one sample, but that may have been a result of the sample preparation process. The cause of the crack is uncertain, as flaking would be an expected result during drilling if test parts have cracked, but no flaking was seen.

A carbon precipitate was noted near the surface of the carbide substrate. It is not yet clear whether this precipitate adds or detracts anything. Intermediate layer of fine grained tungsten carbide at interface (thickness of 15–25 microns) due to NPI process. Diamond-enhanced layer appears well bonded; EDS detection analysis showed no evidence of contamination of the diamond enhanced layer.

1091101 gage insert measurements:

before pressing: 0.31580–0.31595×0.270±0.005 (uncoated)
after pressing: 0.31450–0.31500×0.286±0.002
before and after pressing dimensions do not match A-00010 print, DASH 00 through DASH 04

1091685 surf compact measurements:

before pressing: 0.25330–0.25345×0.205±0.005 (uncoated)
after pressing: 0.25215–0.25320×0.2245±0.002
before and after pressing dimensions do not match A-00010 print, DASH 00 through DASH 04
HTHP processing appears to reduce diameter about 0.001" and increase height about 0.010" (not including layer)

Variations in the Substrate

Although the embodiment described above uses nodules of two different grades of tungsten carbide, this is not necessary. Single grades of carbide can be used, with greater diversity in the formulations of the body of the insert. For instance, grade 413 of Newcomer Products, Inc. contains tungsten carbide in the 4 micron range with 13% binder. This is a grade which has been traditionally used for bonding. In contrast, their harder carbide formulations, such as 410 (4 micron particles, 10% binder), 510 (5 micron particles, 10% binder), or 610 (6 micron particles, 10% binder) would not traditionally be used as the substrate under a bonded layer, but with the disclosed invention, these harder formulations, and others, can now be used.

Variations in Added Layer

Rather than the bare diamonds disclosed above, encrusted diamonds can also be used. Cubic boron nitride (CBN) can be used in addition to, or instead of, diamond.

Additionally, the coating can be sprayed on for better thickness uniformity. A somewhat greater thickness can be used for the coating.

Variations in Inserts

While the specification has referred to inserts throughout, alternate embodiments include a variety of carbide shapes and a variety of methods of retention of these shapes. For example, rather than the well-known inserts having generally cylindrical bodies, elongated segments can be formed to serve similar purposes. Inserts and segments alike can be retained not only by press-fitting, but by bonding to the tool, a mechanical retention, or other available means.

According to a disclosed class of innovative embodiments, there is provided: A carbide component for a boring tool, said carbide component comprising: a body portion comprising carbide, said body portion having a first end adapted for being seated in said boring tool and a second, working, end; wherein said second end of said compact has an outer layer which is attached to said body without a transition layer or adherent material and which contains an ultra-hard material.

According to another disclosed class of innovative embodiments, there is provided: A drilling tool, comprising: a first end adapted for attachment to a drill string; a second end, opposite said first end, containing at least one carbide component, said carbide component comprising a body portion comprising carbide, said body portion having a first end adapted for being seated in said drilling tool and a second, working, end; wherein said second end of said carbide component has an outer layer which is attached to said body without a transition layer or adherent material and which contains an ultra-hard material.

According to another disclosed class of innovative embodiments, there is provided: A drill rig, comprising: a drill string containing at least one section of pipe; a drilling tool connected to said drill string and containing at least one carbide component; and surface equipment capable of rotating said drill string and said drilling tool; wherein said carbide component comprises a body portion of carbide and an outer layer which is attached to said body without a transition layer or adherent material and which contains an ultra-hard material.

According to another disclosed class of innovative embodiments, there is provided: A fabrication method for a carbide component, comprising the steps of: forming a body portion comprising tungsten carbide; sintering said body portion sufficiently to permit handling of said body portion for further processing; applying a coating to a working surface of said body portion, said coating comprising an ultra-hard material; after said applying step, subjecting said body portion and said coating to a high-temperature, high-pressure process to form a finished carbide component; installing said finished carbide component in a drilling tool.

The following background publications provide additional detail regarding possible implementations of the disclosed embodiments, and of modifications and variations thereof, and the predictable results of such modifications:

The Rotary Drilling Series, Unit I, Lesson 2: The Bit (fourth edition), published by the Petroleum Extension Service of The University of Texas at Austin in cooperation with the International Association of Drilling Contractors, which is hereby incorporated by reference.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A drilling tool, comprising:

a first end adapted for attachment to a drill string;

a second end, opposite said fist end, containing at least one carbide component, said carbide component comprising a body portion comprising carbide, said body portion baying a first end adapted for being seated in said drilling tool and a second, working, end;

wherein said second end of said carbide component has an outer layer which is attached to said body without a transition layer or adherent material and which contains an ultra-hard material.

2. The bit of claim 1, wherein said carbide component has a binder content of less than 13%.

3. The bit of claim 1, wherein said carbide component has a binder content of less than 11%.

4. The bit of claim 1, wherein said carbide component is a hemispherical insert.

5. The bit of claim 1, wherein said ultra-hard material is bare diamonds.

6. A drilling tool, comprising:

a first end adapted for attachment to a drill string;

a second end, opposite said first end, containing at least one carbide component, said carbide component comprising a body portion comprising carbide, said body portion having a first end adapted for being seated in said drilling tool and a second, working, end;

wherein said second end of said carbide component has an outer layer which is made of a different composition from said carbide component and is attached to said body without a transition layer or adherent material and which contains an ultra-hard material.

7. A drilling tool, comprising:

a first end adapted for attachment to a drill string;

a second end, opposite said first end, containing at least one carbide component, said carbide component having a binder content of less than 11% and comprising a body portion comprising carbide, said body portion having a first end adapted for being seated in said drilling tool and a second, working, end;

wherein said second end of said carbide component has an outer layer which is attached to said body without a transition layer or adherent material and which contains bare diamonds.

* * * * *